US009939779B2

(12) United States Patent
Fujii

(10) Patent No.: US 9,939,779 B2
(45) Date of Patent: Apr. 10, 2018

(54) IMAGE FORMING APPARATUS

(71) Applicant: CANON KABUSHIKI KAISHA, Tokyo (JP)

(72) Inventor: Masahiko Fujii, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/234,185

(22) Filed: Aug. 11, 2016

(65) Prior Publication Data

US 2017/0060085 A1 Mar. 2, 2017

(30) Foreign Application Priority Data

Aug. 26, 2015 (JP) ..... 2015-166747

(51) Int. Cl.
*G03G 21/20* (2006.01)
*G03G 15/20* (2006.01)

(52) U.S. Cl.
CPC ..... *G03G 21/206* (2013.01); *G03G 15/2017* (2013.01)

(58) Field of Classification Search
CPC ..... G03G 21/206; G03G 15/2017
See application file for complete search history.

(56) References Cited

U.S. PATENT DOCUMENTS 9,329,570 B1 * 5/2016 Mizutani ..... G03G 21/206
2008/0063425 A1 * 3/2008 Idehara ..... G03G 21/1857 399/93
2012/0087693 A1 4/2012 Yamaguchi et al.

FOREIGN PATENT DOCUMENTS

JP 2005-031155 A 2/2005
JP 2012-255977 A 12/2012
JP 2013-195810 A 9/2013
JP 2014-126763 A 7/2014

OTHER PUBLICATIONS

Machine translation of reference Sato (JP Pub No. 2011-242,635 A) Pub Date Dec. 1, 2011.*
U.S. Appl. No. 15/234,194, filed Aug. 11, 2016, Masahiko Fujii, Published as Pub No. US 2017/0060086 A1, Pub Date Mar. 2, 2017.

* cited by examiner

*Primary Examiner* — Rodney Bonnette
(74) *Attorney, Agent, or Firm* — Fitzpatrick, Cella, Harper & Scinto

(57) ABSTRACT

A discharge tray is arranged above a space in which a toner bottle is stored, and a sheet having passed a fixing unit is discharged onto the discharge tray. A cooling fan cools the sheet on which a toner image has been fixed in the fixing unit before the sheet is discharged onto the discharge tray. A duct introduces outer air from an exterior to the cooling fan. A tray-side hole portion is formed in a portion of the discharge tray. Further, a duct-side hole portion is formed in a portion of the duct, and the duct communicates with the space in which the toner bottle is stored through the tray-side hole portion and the duct-side hole portion.

10 Claims, 5 Drawing Sheets

IMAGE FORMING APPARATUS

BACKGROUND OF THE INVENTION

Field of the Invention

The present invention relates to an image forming apparatus, such as a copying machine, a printer, a facsimile machine, or a multifunction machine having the functions of the aforementioned machines.

Description of the Related Art

If a heat source such as a fixing unit is arranged in a vicinity of a toner bottle, i.e., developer storage portion that supplies a developer to an image forming unit forming a toner image, ambient temperature surrounding the toner bottle is increased by the influence of the heat. As a result, the toner stored in the toner bottle is aggregated, possibly causing operation defects and image defects in the image forming apparatus. Therefore, there are demands to suppress the increase of temperature of the toner bottle.

For example, an arrangement is proposed where an insulation member is provided at a connecting portion between a toner bottle cover and a stay supporting a fixing unit, and a fan taking in air from outside the apparatus and blowing air to the toner bottle to cool the bottle is provided (Japanese Unexamined Patent Application Publication No. 2005-31155). Another arrangement is proposed where a duct discharging heat from within the body is arranged between a sheet supporting portion, i.e., discharge tray, and the toner bottle, and forming a portion of the duct by metal to reflect the heat (Japanese Unexamined Patent Application Publication No. 2013-195810).

According to the arrangement disclosed in Japanese Unexamined Patent Application Publication No. 2005-31155, the fan cooling the toner bottle and the insulation member are provided as additional members, so that the manufacturing cost of the apparatus is increased. According to the arrangement disclosed in Japanese Unexamined Patent Application Publication No. 2013-195810, a portion of the duct is formed by metal, so that the rising of temperature of the toner bottle can be suppressed temporarily through heat reflection, but if image forming is performed for a long period of time, a portion of the heat will be absorbed by the metal component and the temperature of the metal component will be increased. Thus, the temperature of the toner bottle arranged in the vicinity of the metal component will also be increased.

SUMMARY OF THE INVENTION

The present invention provides an image forming apparatus capable of reducing the increase of temperature of a toner cartridge arranged in the vicinity of a fixing unit through a simple configuration.

Further features of the present invention will become apparent from the following description of exemplary embodiments with reference to the attached drawings.

DESCRIPTION OF THE EMBODIMENTS

Figure 1:
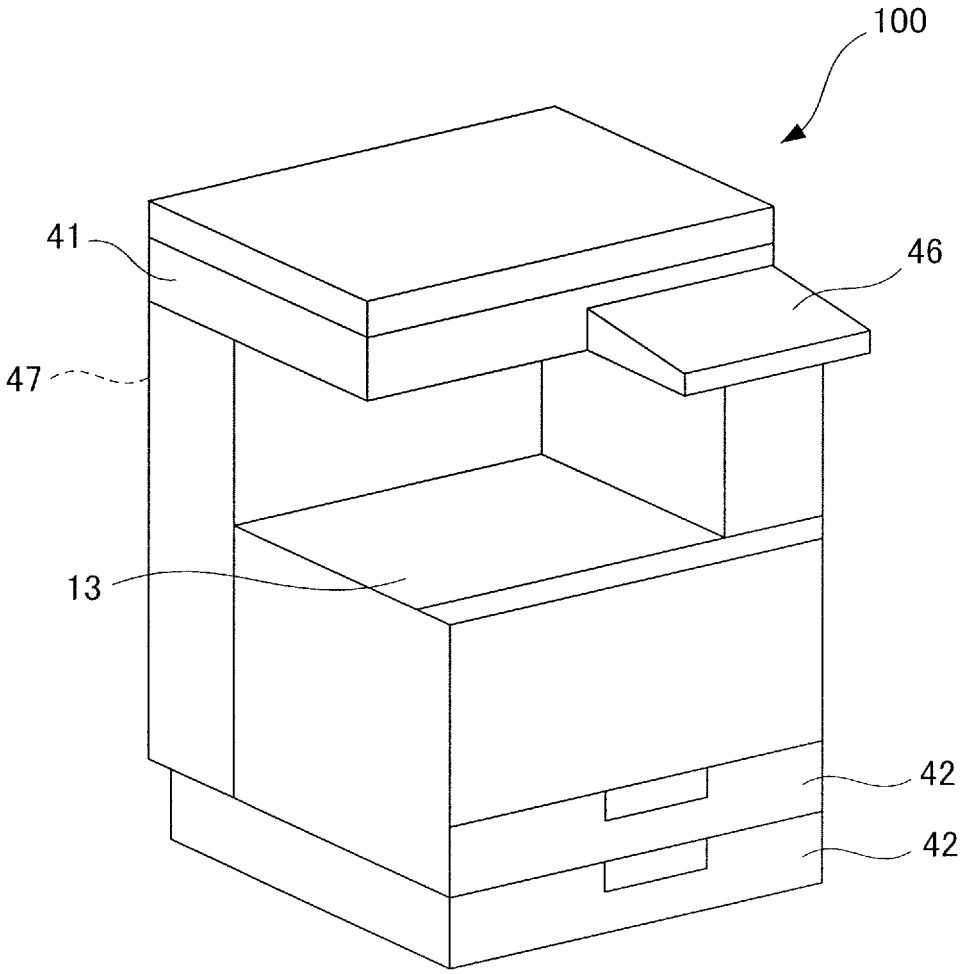
FIG. 1 is a perspective view of a general arrangement of an image forming apparatus according to an embodiment.

Now, a preferred embodiment of the present invention will be described with reference to FIGS. 1 through 5. At first, a general arrangement of an image forming apparatus of the present embodiment will be described with reference to FIGS. 1 and 2.

Image Forming Apparatus

An image forming apparatus 100 according to the present embodiment is an electro-photographic color image forming apparatus having an image forming station of four colors and forming a toner image on a sheet, i.e., paper and plastic sheets, as recording material. The image forming apparatus 100 includes a document reading unit 41, a cassette 42, a sheet conveyance unit 43, an image forming unit 44, a fixing unit 45, an operating unit 46, and an electronic unit 47. These units are stored in a casing 101 of the image forming apparatus 100.

The document reading unit 41 is arranged at an upper portion of the image forming apparatus 100, and reads documents. The image forming unit 44 includes four process cartridges 3 as image forming stations of four colors. The process cartridges 3 of the respective colors each have a photosensitive drum 6, i.e., photoreceptor, as an image bearing member, and a charging unit, a developing unit and a cleaner, which are not shown, are arranged in a circumference of the photosensitive drum 6. Further, the image forming unit 44 has an exposing unit 2 arranged below the respective process cartridges 3. The arrangements of the process cartridges 3 are the same, so in FIG. 2, reference numbers are assigned to only a part of the process cartridges, and the others are not shown.

An intermediate transfer belt 7, i.e., intermediate transfer body, is arranged at an upper portion of the image forming unit 44 so that the belt is in contact with the photosensitive drums of the respective colors. The photosensitive drums 6 and the intermediate transfer belt 7 are respectively driven to rotate. The respective photosensitive drums 6 contact the intermediate transfer belt 7 at respective primary transfer portions. A primary transfer roller 5, i.e., primary transfer means, is arranged at a position opposing to the respective photosensitive drums 6 with the intermediate transfer belt 7 interposed therebetween in each primary transfer portion. Further, the intermediate transfer belt 7 contacts a secondary transfer roller 8 downstream, in a direction of rotation, of the respective primary transfer portions, and forms a secondary transfer portion.

Toner bottles 12 of four colors are arranged above the intermediate transfer belt 7 as developer storing units supplying developers, i.e., toners, to developing units in the process cartridges 3 of respective colors of the image forming unit 44. In other words, the respective toner bottles 12 are developer storage units storing developers used in the image forming unit 44. Each developer storage unit includes the toner bottle 12, and a retaining portion retaining the toner bottle 12.

The respective toner bottles 12 have substantially cylindrical shapes, and are arranged so that a longitudinal direction, that is, a direction along a central axis of the cylinder, corresponds to a front-rear direction of the image forming apparatus 100, and aligned side by side in a direction of rotation of the intermediate transfer belt 7. The front of the image forming apparatus 100 refers to a front side where the operating unit 46 (described later) is arranged, and the rear of the apparatus 100 refers to a back side where the electronic unit 47 (described later) is arranged. A toner used highly frequently (black, for example) is stored in the toner bottle 12 arranged as the rightmost toner bottle 12 in FIG. 2, and thus toner bottle 12 has a greater capacity, i.e., outer diameter, than the other toner bottles.

The cassette 42 stores sheets S, and the sheet conveyance unit 43 conveys the sheets S stored in the cassette 42 to a secondary transfer portion. The sheet conveyance unit 43 includes a pickup roller 10, a registration roller 9, a reverse conveyance roller 17, a discharge roller 18, and so on. In the illustrated example, the sheet conveyance unit 43 is arranged to convey the sheets in an approximately vertical direction at a right side of FIG. 2.

The fixing unit 45 is arranged downstream of the secondary transfer portion with respect to a direction of conveyance of the sheet S. The fixing unit 45 forms a fixing nip portion by abutting a heating roller and a counter roller against each other. A heater as a heat source is arranged inside the heating roller.

The operating unit 46 is arranged on a front side of the image forming apparatus 100 and has an operation button, an operation panel and so on, allowing a user to control settings or the like of the image forming apparatus 100 through operation of the operating unit. The electronic unit 47 is arranged on a rear side of the image forming apparatus 100, and includes a power supply supplying power to respective units, a control unit controlling the respective units, and so on.

When forming images, at first, a surface of the photosensitive drum 6 is charged using a charging unit. Next, the photosensitive drum is exposed using the exposing unit 2 according to image information of a document read via the document reading unit 41 or image information entered from an external terminal, such as a personal computer, and a latent image corresponding to each color is formed on each photosensitive drum 6. The respective latent images are developed by the developing unit, and a toner image of each color is respectively formed on the surface of each photosensitive drum 6.

Along with the rotation of the photosensitive drum 6, the toner image arrives at a primary transfer portion where the photosensitive drum 6 abuts against the intermediate transfer belt 7. Then, by applying a primary transfer bias to the primary transfer roller 5, the toner images on the respective photosensitive drums 6 are sequentially transferred to the intermediate transfer belt 7, and a full-color toner image is formed on the intermediate transfer belt 7.

On the other hand, the sheets S stored in the cassette 42 are sent out sheet by sheet via the pickup roller 10. Then, the sheet S is transferred by the registration roller 9 to the secondary transfer portion at a matched timing with the toner image on the intermediate transfer belt 7, and the toner image on the intermediate transfer belt 7 is secondarily transferred to the sheet S. Thereafter, the sheet S onto which the toner image has been transferred is conveyed to the fixing nip portion of the fixing unit 45 and heated therein. That is, the toner image is heated by receiving heat and pressure at the fixing nip portion, by which the toner is melted, mixed and fixed onto the sheet S. The sheet S having passed the fixing unit 45 and on which the toner image is fixed is discharged onto a discharge tray 13 by the discharge roller 18 provided downstream of the fixing unit 45.

The discharge tray 13 is arranged within the casing 101 of the image forming apparatus 100 and above a space 12*a*, i.e., storage unit, storing the respective toner bottles 12. The document reading unit 41 is arranged above the discharge tray 13 interposing a discharge space on which the sheet S has been discharged. The present embodiment adopts a so-called in-body sheet ejection arrangement where the sheet S is discharged between the document reading unit 41 and the discharge tray 13.

In a case where the sheets should be subjected to duplex printing, the sheet S having the toner image fixed to the surface is conveyed to a reverse conveyance path. In the reverse conveyance path, the sheet S is reversed by the reverse conveyance roller 17, and the sheet is conveyed again to the secondary transfer portion. Then, after having a toner image transferred to a back surface of the sheet S, the sheet S is conveyed to the fixing unit 45, and discharged by the discharge roller 18 onto the discharge tray 13.

The sheet S on which the toner image has been fixed by the fixing unit 45 is cooled by a cooling fan 15 before being discharged onto the discharge tray 13. The cooling fan 15 is arranged between the fixing unit 45 and the discharge roller 18 with respect to the conveyance passage of the sheet S, and blows air onto the sheet S having passed the fixing nip portion to cool the sheet S having been heated in the fixing unit 45. Outer air from outside the casing 101 is introduced through a duct 16 to the cooling fan 15. That is, the duct 16 has one end opened to the outside, and another end connected to an intake side of the cooling fan 15.

As described above, the discharge tray 13 is arranged above the space 12*a*, i.e., storage unit, in which the toner bottle 12 is stored. Therefore, if the sheet S having been heated is discharged and stacked on the discharge tray 13, the heat of the sheet S may cause increase of the temperature of the toner bottle 12, by which the toner within the toner bottle 12 maybe aggregated. Therefore, according to the present embodiment, the sheet S is cooled by the cooling fan 15, so that the rising of temperature of the toner bottle 12 by the heat of the sheet S can be suppressed.

Figure 2:
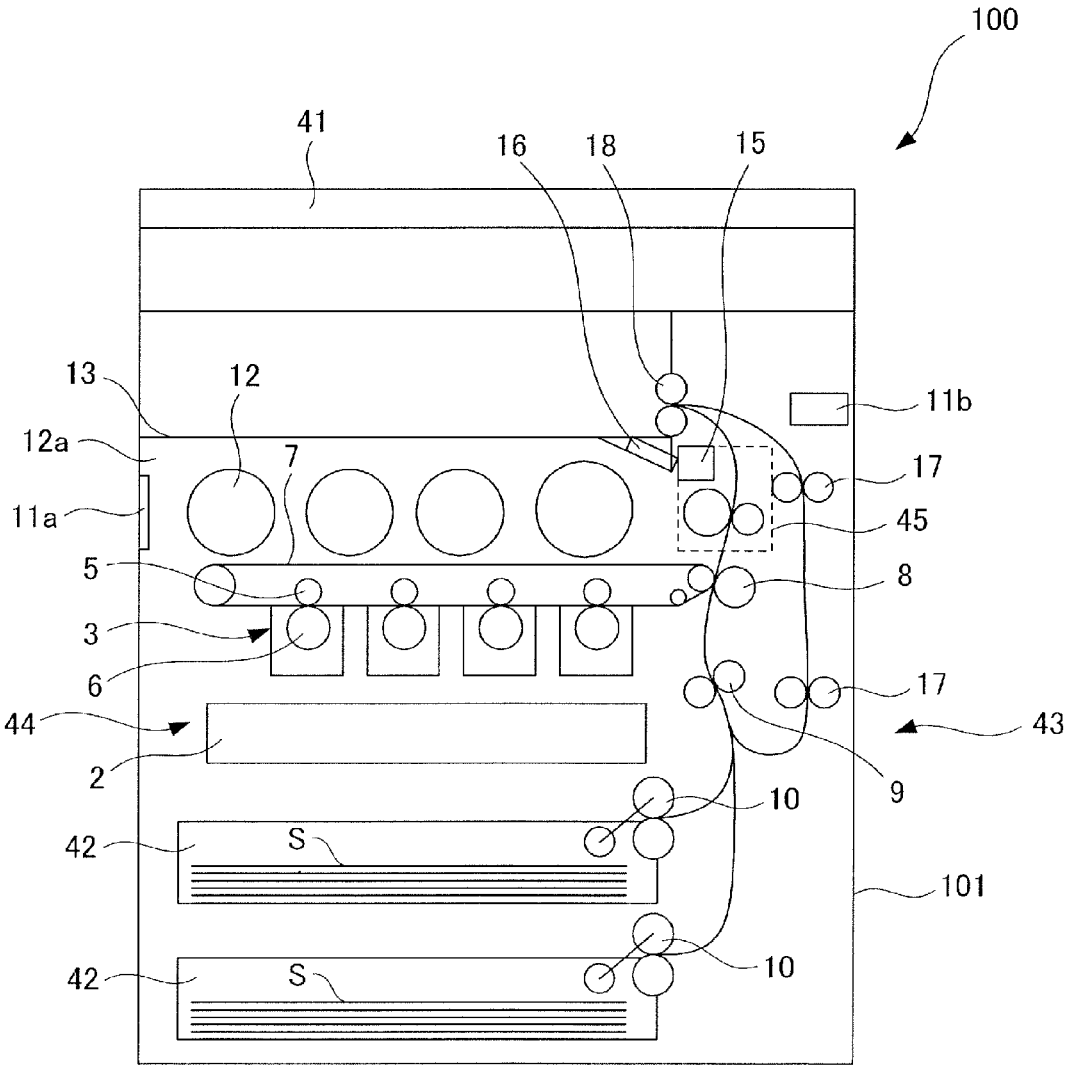
FIG. 2 is a cross-sectional view of a general arrangement of the image forming apparatus according to the embodiment.

On the other hand, as illustrated in FIG. 2, a fixing unit 45 as heat source is arranged next to the space 12*a* in which the toner bottle 12 is stored. The space 12*a* and the space in which the fixing unit 45 is arranged are divided by a partition wall 102 (refer to FIGS. 3 and 4 described later), but the heat of the fixing unit 45 may heat the space 12*a* and may raise the temperature of the toner bottle 12. Therefore, according to the present embodiment, the space 12*a* in which the toner bottle 12 is stored is communicated with the duct 16.

Communication of Space in which Toner Bottle is stored with the Duct

An arrangement of the communication between the space in which the toner bottle is stored and the duct in the present embodiment will be described with reference to FIGS. 3 through 5. As described above, the fixing unit 45 heated to a high temperature is arranged in the vicinity of the toner bottle 12 via the partition wall 102. Therefore, the heat generated in the fixing unit 45 raises an ambient temperature of the space 12*a* in which the toner bottle 12 is stored, which may accelerate deterioration of the toner within the toner bottle 12, and possibly causes image defects by the aggregation of the toner.

One idea to reduce a quantity of heat generated from the fixing unit 45 is suppressing the productivity of the image forming apparatus temporarily, as one arrangement for suppressing increase of temperature of the toner bottle 12. Another idea is to additionally provide a new dedicated member cooling a vicinity of the toner bottle 12. However, if the productivity of the image forming apparatus is temporarily suppressed, the ability of the apparatus itself will be deteriorated. Further, if a dedicated member is provided to cool the vicinity of the toner bottle 12, the cost of the apparatus will be increased.

Figure 3:
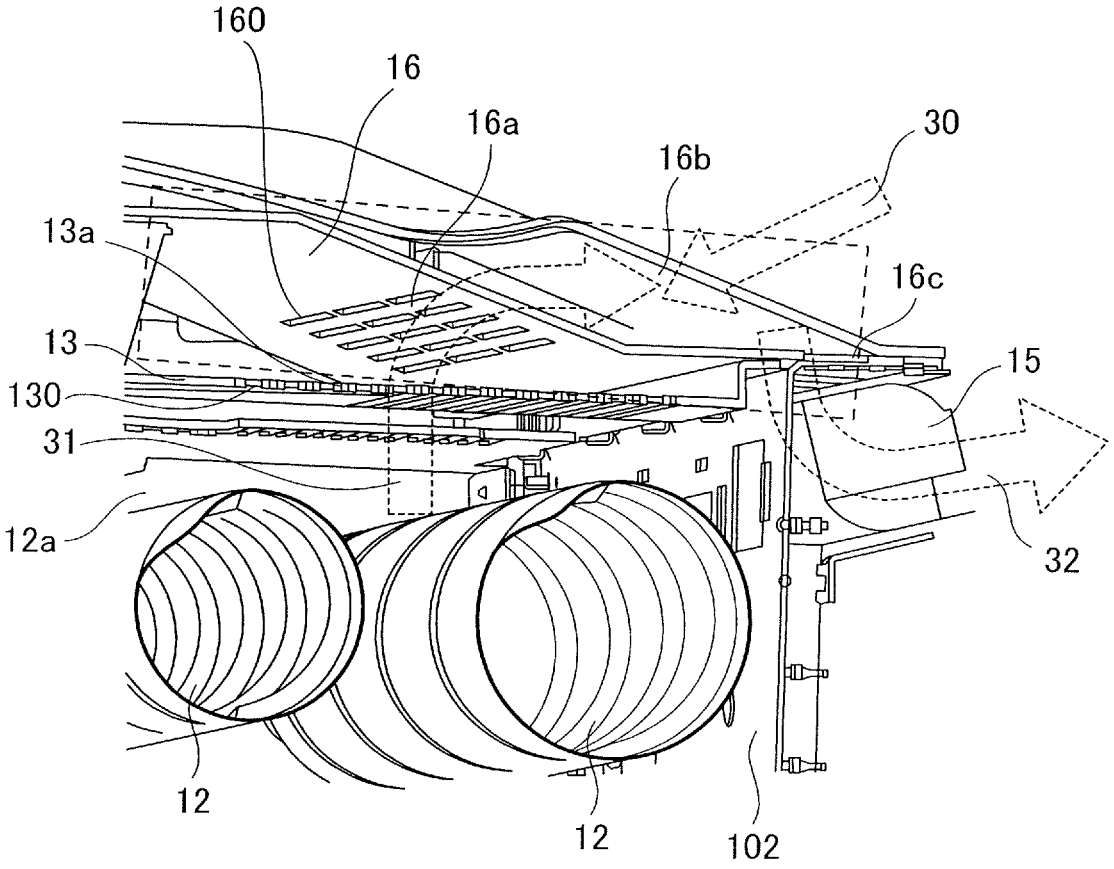
FIG. 3 is a perspective view of a flow passage of a cooling fan, with a portion of the image forming apparatus according to the embodiment cut away.
Figure 4:
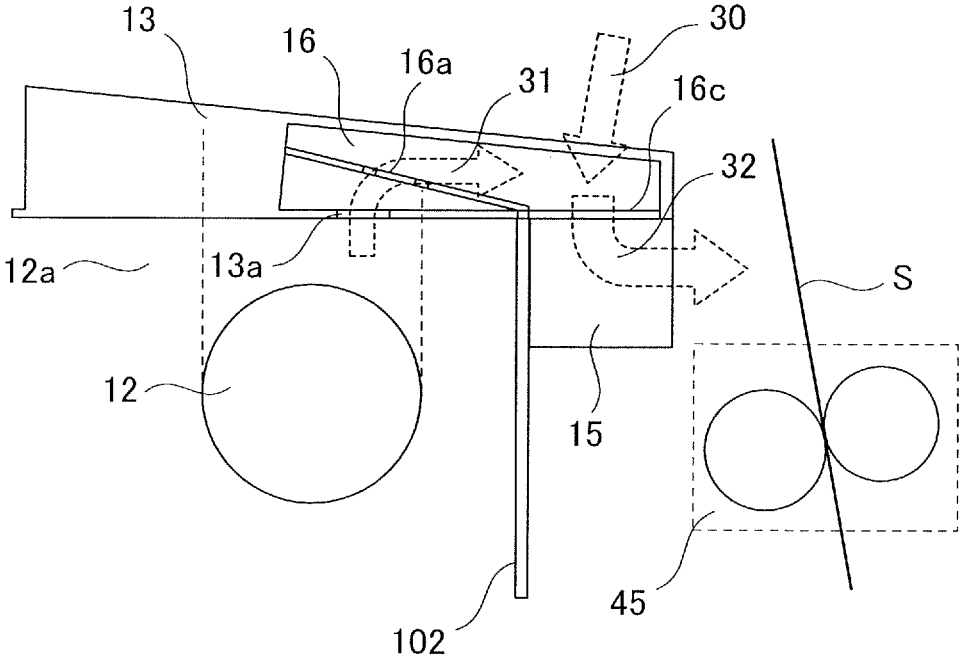
FIG. 4 is a cross-sectional view of a flow passage of the cooling fan, with a portion of the general arrangement of the image forming apparatus according to the embodiment cut away.

Therefore, according to the present embodiment, a tray-side hole portion 13*a* is formed in a part of the discharge tray 13, and a duct-side hole portion 16*a* is formed in a part of the duct 16, as illustrated in FIGS. 3 and 4. Specifically, a part of the duct 16 is arranged above the discharge tray 13, closely opposing a part of the discharge tray 13. The tray-side hole portion 13*a* and the duct-side hole portion 16*a* are respectively formed at mutually opposed areas. The space 12*a*, i.e., storage unit, in which the toner bottles 12 are stored is communicated with the duct 16 through the tray-side hole portion 13*a* and the duct-side hole portion 16*a*. As described, the duct 16 is connected to the cooling fan 15, so that the air within the space 12*a* is drawn toward the cooling fan 15 through the tray-side hole portion 13*a*, the duct-side hole portion 16*a* and the duct 16.

As illustrated in FIG. 2, an intake port 11*a* and an exhaust port 11*b* are provided on the casing 101 of the image forming apparatus 100, so that outer air is introduced into the casing 101 through the intake port 11*a*, and the air within the casing 101 is discharged through the exhaust port 11*b*. The intake port 11*a* is provided on a wall surface on an opposite side (left side of FIG. 2) from the side in which the fixing unit 45 is arranged in the casing 101, for example. The outer air introduced through the intake port 11*a* fills the space 12*a* in which the toner bottles 12 are stored, and then drawn toward the cooling fan 15. The exhaust port 11*b* is provided on a wall surface at a rear side of the casing 101 in a vicinity of the fixing unit 45, for example. The air within the casing 101 can be discharged through the exhaust port 11*b* to the exterior. A ventilating fan can be provided integrally to the exhaust port 11*b*.

Duct

Next, the duct 16 will be described in further detail. The duct 16 is arranged above a base end side, i.e., upstream side in a sheet discharging direction of the discharge roller 18, of the discharge tray 13 and above the cooling fan 15, and below the discharge roller 18. Therefore, the sheet S discharged by the discharge roller 18 passes the area above the duct 16 and is supported on the discharge tray 13. Further, as illustrated in FIG. 3, the duct 16 is assembled from two plate members arranged along a front-rear direction of the image forming apparatus 100 and forms a space between the plate members, the space being closed at a rear side and opened at a front side. The front side opening is referred to as an entrance-side opening 16*b*, i.e., first suction port. A lower plate member of the two plate members constituting the duct 16 has an exit-side opening 16*c* at an area positioned above the cooling fan 15, and has a duct-side hole portion 16*a*, i.e., second suction port, arranged at a portion positioned above the discharge tray 13. The shape of the duct is not restricted to the above-described example, and can be rectangular, cylindrical, and so on.

Figure 5:
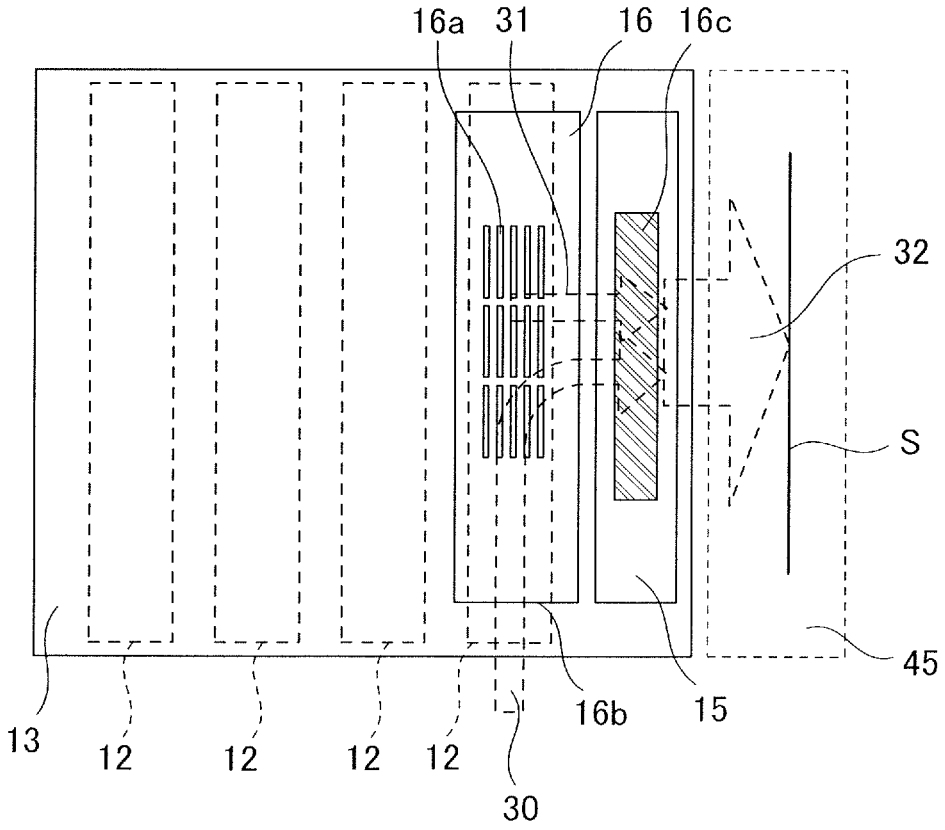
FIG. 5 is a schematic diagram illustrating a flow passage of the cooling fan, showing a portion of the general arrangement of the image forming apparatus according to the present embodiment from an upper direction of FIG. 2.

The duct 16 arranged as above has the entrance-side opening 16*b* opened on the front side of the image forming apparatus 100, and as illustrated in FIGS. 3 through 5, introduces outer air from the front side of the image forming apparatus 100. On the other hand, as illustrated in FIGS. 3 and 4, the exit-side opening 16*c* of the duct 16 is formed to be opened above the cooling fan 15, and connects to the intake port of the cooling fan 15. The duct-side hole portion 16*a*, i.e., second suction port, is formed on the lower surface of the duct 16 between the entrance-side opening 16*b*, i.e., first suction port, and the exit-side opening 16*c*, so as to communicate with the tray-side hole portion 13*a*.

Therefore, as illustrated in FIGS. 3 through 5, in a case where the cooling fan 15 is driven, an outer air flow passage 30 introducing outer air through the entrance-side opening 16*b* and a toner bottle flow passage 31 through which the air in the space 12*a* storing the toner bottles 12 is drawn are merged in the duct 16. The air merged within the duct 16 flows to the exit-side opening 16*c*, and is drawn by the cooling fan 15. That is, both the air in the space 12*a* storing the toner bottles 12 and outer air can be drawn simultaneously by driving the cooling fan 15. The cooling fan 15 blows the air drawn in this manner to the sheet S having passed the fixing unit 45 (cooling air flow passage 32).

The above-described flow of air created by the cooling fan 15 will be described in further detail with reference to FIG. 5. The outer air flow passage 30 is a passage that takes in outer air from the front side of the image forming apparatus 100 through the entrance-side opening 16*b*, and guides the air to the exit-side opening 16*c* on the right side of FIG. 5. On the other hand, the toner bottle flow passage 31 is a passage that takes in the air within the space 12*a* storing the toner bottles 12 arranged below the discharge tray 13 positioned below the duct 16 through the tray-side hole portion 13*a* and the duct-side hole portion 16*a*, and guides the air to the exit-side opening 16*c*. These passages are merged within the duct 16, and the merged air is drawn by the cooling fan 15 and blown onto the sheet S as the cooling air flow passage 32, by which the sheet S is cooled. The air blown onto the sheet S is discharged through the exhaust port 11*b*.

Tray-Side Hole Portion and Duct-Side Hole Portion

Next, the tray-side hole portion 13*a* and the duct-side hole portion 16*a* will be described in further detail. It should be noted that the toner bottle 12 described in the following description refers to the toner bottle 12 positioned closest to the fixing unit 45, i.e., the rightmost toner bottle of FIG. 2. The tray-side hole portion 13*a* and the duct-side hole portion 16*a* are respectively composed of holes 130 and 160 formed in multiple numbers along both a longitudinal direction of the toner bottle 12 and a direction orthogonal to the longitudinal direction, as illustrated in FIG. 3. That is, the holes 130 of the tray-side hole portion 13*a* are formed in multiple numbers, and penetrate a portion of a base end side of the plate-like discharge tray 13. A plurality of such holes 130 is arranged along the longitudinal direction of the toner bottle 12 and along the direction orthogonal to the longitudinal direction. Moreover, the holes 130 are provided across approximately a whole area in the longitudinal direction of the toner bottle 12 on the discharge tray 13. It is preferable that the tray-side hole portion 13*a* is formed within a range equal to or greater than a length opposed to the whole area in the longitudinal length of the toner bottle 12, but at least the length in the longitudinal direction of the toner bottle 12 is set to be longer than the length in the longitudinal direction of the duct-side hole portion 16*a*.

On the other hand, the holes 160 of the duct-side hole portion 16*a* are formed in multiple numbers, and penetrate a portion of the lower-side plate member constituting the duct 16. A plurality of such holes 160 is arranged along the longitudinal direction of the toner bottle 12 and along the direction orthogonal to the longitudinal direction. The duct-side hole portion 16*a* is designed so that the holes 160 are formed at least within a range in the longitudinal direction of a projection of the toner bottle 12 on the duct 16. According to the present embodiment, the duct-side hole portion 16*a* is formed at a center portion in the longitudinal direction of the projection of the toner bottle 12, as illustrated in FIG. 5.

Specifically, the duct-side hole portion 16*a* is provided at a center portion inward by 20% from both end portions in the longitudinal direction of the toner bottle 12, and within a range of length equal to or greater than 30% the toner bottle length. It is preferable that the duct-side hole portion 16*a* is formed in a range of 30% or greater and 50% or smaller the length of the toner bottle 12 with respect to the longitudinal direction of the toner bottle 12. This is because if the length of the duct-side hole portion 16*a* in the longitudinal direction is too small, air cannot be taken in efficiently from the whole longitudinal area of the toner bottle 12 within the space 12*a*. On the other hand, if the longitudinal length of the duct-side hole portion 16*a* is too long, the toner bottle flow passage 31 may be disturbed, and the air within the space 12*a* cannot be taken in efficiently.

Further, the duct 16 is arranged so that the duct-side hole portion 16*a* and the tray-side hole portion 13*a* are at least partially opposed to each other. Specifically, the duct-side hole portion 16*a* and the tray-side hole portion 13*a* are formed so that at least a part of the hole portions is overlapped with the area of the toner bottle 12 projected upward in the vertical direction, as illustrated in FIG. 4. Thereby, the heated air above the toner bottle 12 can be drawn upward efficiently, and the rising of temperature of the toner bottle 12 can be suppressed more efficiently.

As described, according to the present embodiment, the atmosphere of the space 12*a* in which the toner bottle 12 is stored is taken in by the cooling fan 15, forming the toner bottle flow passage 31. The toner bottle flow passage 31 is merged with the outer air flow passage 30 within the duct 16 and forms the cooling air flow passage 32, and the air is blown against the sheet S. In this state, the air temperature of the outer air flow passage 30 is warmed by being merged with the toner bottle flow passage 31. However, the air temperature of the cooling air flow passage 32 blown from the cooling fan 15 is sufficiently low compared to the temperature of the sheet S immediately after having the image fixed, so that the ability required to cool the sheet S is not influenced thereby.

Further, the air within the space 12*a* in which the toner bottle 12 is stored is taken in by the cooling fan 15 as described earlier, so that the rising of temperature of the toner bottle 12 stored in the space 12*a* can be suppressed. Further, since a metal component as the one described in Japanese Unexamined Patent Application Publication No. 2013-195810 is not used to suppress the rising of temperature of the toner bottles 12, the rising of temperature of the toner bottle 12 can be suppressed for a long period of time. Thus, the rising of temperature of the toner bottle 12 can be suppressed even if image forming is performed for a long time, and the occurrence of aggregation of toner can be suppressed.

Furthermore, according to the present embodiment, the air within the space 12*a* in which the toner bottle 12 is stored is taken in by the cooling fan 15 to cool the sheet S. That is, the rising of temperature of the toner bottle 12 can be suppressed using an existing configuration. The configuration is realized by simply arranging the duct 16 in the vicinity of the discharge tray 13, and forming the duct-side hole portion 16*a* and the tray-side hole portion 13*a*, respectively, on the duct 16 and the discharge tray 13, so that manufacturing costs can be suppressed.

Furthermore, since the rising of temperature of the toner bottle 12 can be suppressed without declining the productivity of the image forming apparatus when the temperature of the toner bottle 12 has risen, so that image forming can be performed for a long period of time without declining the productivity, and the occurrence of aggregation of toner accompanying the rising of temperature of the toner bottle 12 can be suppressed. As described above, an image forming apparatus realizing stable productivity and image quality can be provided.

Other Embodiments

According to the above description, the tray-side hole portion 13*a* is formed above the toner bottle 12 at the rightmost side of the bottles of FIG. 2, but the tray-side hole portion 13*a* can be formed above other toner bottles, depending on the arrangement of the toner bottles and the duct. Further, the tray-side hole portion 13*a* can also be formed above a plurality of toner bottles.

According further to an arrangement where a developing unit storing a developer is arranged in a space below the discharge tray 13, the developer storage portion corresponds to the developing unit. In that case, the air in the space in which the developing unit is stored is taken in through the duct via the tray-side hole portion and the duct-side hole portion, as described above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-166747 filed Aug. 26, 2015, which is hereby incorporated by reference herein in its entirety.

What is claimed is:

1. An image forming apparatus comprising:

an image forming unit configured to form a toner image on a recording material;

an image heating apparatus configured to heat the toner image on the recording material formed in the image forming unit;

a storage unit configured to store at least a developer storage portion storing toner;

a tray, arranged above the storage unit in a vertical direction of the image forming apparatus, configured to stack the recording material discharged from the image forming apparatus after the toner image has been heated;

an air flow passage formed between the storage unit and the tray, and having a suction port configured to introduce outside air;

a hole portion, provided above the storage unit in a vertical direction, and configured to communicate a space in which the storage unit is arranged with the air flow passage; and a fan, disposed between the hole portion and the image heating apparatus, and configured to blow air sent from the air flow passage to the recording material after the toner image was heated and before the recording material is discharged onto the tray.

2. The image forming apparatus according to claim 1, wherein the hole portion is provided at least within a range in a longitudinal direction of a projection of the developer storage portion along the air flow passage.

3. The image forming apparatus according to claim 2, wherein the hole portion is provided at least at a center portion in the longitudinal direction of the range of the projection of the developer storage portion along the air flow passage.

4. The image forming apparatus according to claim 2, wherein the hole portion is formed within a range from 30% to 50% of a length of the developer storage portion with respect to the longitudinal direction of the developer storage portion.

5. The image forming apparatus according to claim 1, wherein each of the suction port and the hole portion is formed to be at least partially overlapped with a range of a projection of the developer storage portion projected upward in the vertical direction.

6. The image forming apparatus according to claim 1, wherein the hole portion comprises a plurality of holes formed along a longitudinal direction of the developer storage portion and a plurality of holes formed along a direction orthogonal to the longitudinal direction.

7. The image forming apparatus according to claim 1, further comprising a partition configured to partition the air flow passage and the storage unit, wherein the hole portion is formed in the partition.

8. The image forming apparatus according to claim 1, further comprising a side plate provided between the storage unit and the fan.

9. The image forming apparatus according to claim 1, wherein in the vertical direction, the fan is provided above the image heating apparatus.

10. The image forming apparatus according to claim 1, wherein the storage unit is one of a plurality of storage units each of which stores toner of a different color, and wherein in the vertical direction, the suction port is provided above a storage unit closest to the image heating apparatus among the plurality of storage units.

* * * * *